United States Patent [19]

Olander et al.

[11] 4,165,452

[45] Aug. 21, 1979

[54] IGNITION DISTRIBUTOR ELECTRODE FOR SUPPRESSING RADIO FREQUENCY INTERFERENCE

[75] Inventors: William C. Olander, Birmingham; William G. Trabold, Royal Oak; Douglas J. Harvey, Sterling Heights, all of Mich.; Robert W. Vest, West Lafayette, Ind.

[73] Assignee: General Motors Corporation, Detroit, Mich.

[21] Appl. No.: 868,079

[22] Filed: Jan. 9, 1978

[51] Int. Cl.[2] ..... H01H 19/00; H01H 1/00

[52] U.S. Cl. ..... 200/19 DR; 123/146.5 A; 123/148 R; 123/148 P; 200/19 R; 200/262; 200/264

[58] Field of Search ..... 200/19 R, 19 DR, 19 DC, 200/262-270, 279; 123/148 R, 146.5 A, 148 P

[56] References Cited

U.S. PATENT DOCUMENTS

| | | | |
|---|---|---|---|
| 1,395,269 | 11/1921 | Gebauer | 200/270 X |
| 2,294,783 | 9/1942 | Ely | 200/264 |
| 3,317,773 | 5/1967 | Inoue | 313/141 |
| 4,007,342 | 2/1977 | Makino et al. | 200/19 R |
| 4,039,787 | 8/1977 | Hori et al. | 200/19 DR X |
| 4,074,090 | 2/1978 | Hayashi et al. | 200/19 DR |
| 4,091,245 | 5/1978 | Komiyama et al. | 200/19 R |

FOREIGN PATENT DOCUMENTS

| | | | |
|---|---|---|---|
| 576566 | 4/1946 | United Kingdom | 200/266 |

*Primary Examiner*—James R. Scott
*Attorney, Agent, or Firm*—George A. Grove

[57] ABSTRACT

An ignition distributor for an internal combustion engine is provided with a novel rotor electrode which substantially reduces radio frequency interference generated by spark discharges across the rotor gap. At least the tip segment of the rotor electrode is formed of a composite material consisting of a dielectric phase interspersed with a conductive metal phase. In operation, the dielectric phase protrudes from the surface of the electrode promoting ionization in the rotor gap so that electrical discharge occurs at voltages where radio frequency signal production is substantially suppressed.

5 Claims, 11 Drawing Figures

IGNITION DISTRIBUTOR ELECTRODE FOR SUPPRESSING RADIO FREQUENCY INTERFERENCE

This application is related to U.S. Ser. No. 868,078, filed Jan. 9, 1978, assigned to the assignee of this invention.

BACKGROUND OF THE INVENTION

This invention relates to ignition distributors for internal combustion engines having novel rotor electrodes which suppress radio frequency noise generation. More particularly, the invention relates to distributor rotors wherein at least the tip of the rotor electrode comprises a material containing a substantial portion of a dielectric phase interspersed with a conductive metal phase. The dielectric phase protrudes from the metal phase at the tip adjacent to the rotor gap. In the operation of the distributor, electrical phenomena associated with the protruding dielectric phase lead to significant reduction of the voltage required to break down the gap between the rotor electrode and a stationary spark plug lead terminal (hereinafter rotor gap). At such lowered breakdown voltages radio frequency interference is appreciably suppressed.

It is well known that radio frequency interference (RFI) in vehicles powered by spark ignition internal combustion engines is brought about for the most part by high voltage spark discharges across the rotor gap. The source of the RFI signal is the large, fast rise time impulsive current generated at the onset of the rotor gap breakdown. It has been noted that the higher the voltage required to break down the gap, the higher the intensity of the radio frequency interference noise. This is particularly troublesome with modern high energy ignition distributors which at present generally have breakdown voltages at the rotor gap of over 20 kV. We have found that if such breakdown voltage is reduced to less than about 12 kV, the production of radio frequency energy is suppressed and the radio noise substantially reduced.

OBJECTS OF THE INVENTION

It is therefore an object of our invention to provide a RFI noise suppressing ignition distributor. It is a further object to provide an ignition distributor with a high tension rotor electrode that encourages the electrical breakdown of the rotor gap at voltages where RFI signal generation is substantially suppressed. It is a more specific object of our invention to provide such an electrode wherein at least the tip of the rotor electrode consists of a two-phase material having a dielectric portion interspersed with an electrically conductive portion. The dielectric portion of the material protrudes from the end of the tip promoting electrical breakdown of the rotor gap at voltages where RFI is substantially suppressed. Another object of our invention is to provide high tension rotor electrodes fabricated from such two-phase composite materials with long service lives. The rotor electrodes of our invention provide continuous RFI suppression due to unique wear characteristics wherein the dielectric phase always protrudes at the spark gap. It is another object to provide a two-phase composite material for RFI suppressing rotor electrodes wherein the dielectric portion consists of microscopic particles or tiny fibers in a conductive metal matrix. The particles protrude from the surface of the material adjacent to the rotor gap to promote RFI suppression while a portion of each particle is firmly anchored in the metal.

BRIEF SUMMARY OF THE INVENTION

In accordance with a preferred embodiment of the invention, these and other objects are accomplished as follows. A conventional internal combustion engine ignition distributor is equipped with a rotor mounted on a rotor shaft adapted to be rotated by the engine cam shaft. The distributor rotor carries an electrode that is in electrical contact with a source of high voltage electrical energy. The radially outboard tip of the rotor electrode traces a circumferential path that successively brings it into successive registrations with one or more circumferentially spaced stationary spark plug cable lead terminals positioned in the distributor cap. In our invention, at least the tip of the rotor electrode is made of a suitable dielectric material such as a silica glass interspersed with a suitable electrically conductive material such as copper. The dielectric material extends radially outboard the conductive material at the surface of the tip adjacent to the rotor gap. When the rotor electrode of an operating distributor moves into close proximity to a spark plug cable lead terminal, the protruding dielectric material is believed to produce a non-uniform electric field promoting electrical phenomena which cause the gap to break down at lower voltages than a standard metal rotor tip segment. We have found that when the tip is made of a composite material containing at least 10% by volume dielectric material interspersed with a conductive material, rotor gap breakdown voltages are appreciably lowered and RFI noise is substantially suppressed.

BRIEF DESCRIPTION OF THE DRAWINGS

Our invention will be more fully appreciated and clearly understood from a detailed description which follows. Reference will be made to the drawings in which.

DETAILED DESCRIPTION OF THE INVENTION

Figure 1:
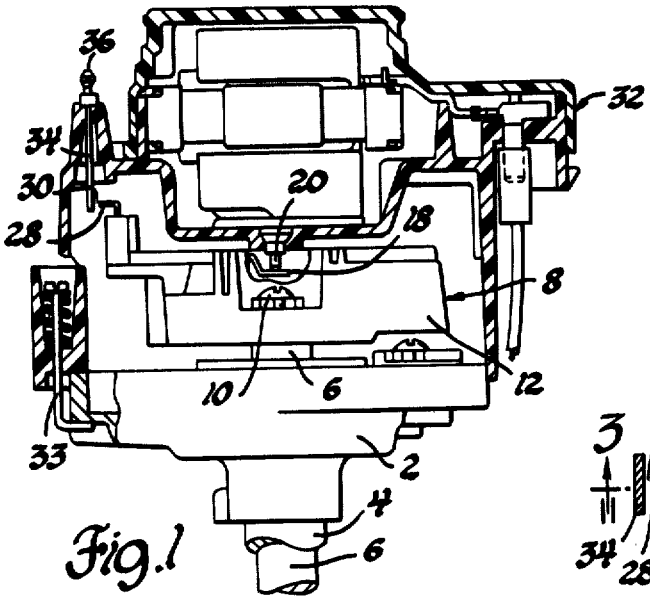
FIG. 1 is an elevational view, partly broken away and in section, of an automobile ignition distributor showing a distributor rotor electrode of our invention positioned in spark gap relation to a stationary spark plug cable electrode.

In a preferred embodiment and referring to FIG. 1, a view of a typical high energy automobile ignition distributor is shown. A distributor housing 2 is mounted on a stationary rotor shaft housing 4. Confined within housing 4 is rotor driving shaft 6 which is generally gear coupled with the engine cam shaft. A rotor 8 is mounted on the driving shaft 6 by screws 10 so that the rotor 8 rotates with the driving shaft 6. The rotor 8 comprises an insulating base 12 which is generally molded from an electrically nonconductive thermoplastic molding material. As can be seen more clearly in FIG. 2, a two-part conductive rotor electrode 14 is mounted in the plastic rotor base 12. The electrode 14 extends radially from the center of rotation 16 of the rotor 8 slightly beyond the outside perimeter of the rotor base 12. In the illustrated embodiment of our invention, the radially inward portion 18 of the electrode 14 is a flat stainless steel strip which is slightly bent so as to bias against protruding secondary coil high tension electrode 20 assuring electrical connection therebetween. As seen clearly at FIG. 3, the radially outward portion 22 of electrode 14 is clamped against the radially inward portion 18 by tab 24. An electrical connection is formed between the two rotor electrode portions at interface 26. At least the tip 28 of the outward portion 22 of electrode 14 is made of a composite material according to our invention wherein dielectric particles protrude from the metal of the tip 28 adjacent rotor gap 30. The remainder of the electrode portion 22 may be made of any suitable conductive material such as copper. It should be noted that other rotor designs would be equally suitable for the practice of our invention so long as at least the tip of the electrode is incorporated according to our invention.

Referring to the cut-away section of FIG. 1, ignition distributor cap 32 is mounted on the distributor rotor housing 2 by means of spring loaded clips 33. A plurality of high tension spark plug cable lead terminals 34 are mounted in the cap 32 in a circular pattern. During operation, a spark plug cable is connected to each spark plug cable terminal at a connector 36. The terminals 34 are positioned in the cap 32 so that they successively come into spark gap relation with the rotor electrode tip 28 as the rotor 8 is driven by the driving shaft 6. The space between the rotor electrode tip 28 when it is radially aligned with a spark plug cable lead terminal 34 is referred to as the rotor gap 30. It is across this gap that high energy ignition sparks are generated to induce a high voltage in the associated spark plug cable in order to fire the connected plug.

The operation of a distributor such as that shown in FIGS. 1 to 3 as it pertains to the practice of our invention can be described briefly as follows. As rotor 8 is turned by driving shaft 6, an electric signal passes through a primary distributor coil to electrical ground. In order to successively fire the spark plugs, at certain points in the rotation of the rotor, an ignition module stops the flow of current through the primary winding thereby inducing a high voltage impulse in the secondary coil and terminal 20. This occurs at about the same time the rotor electrode tip 28 is lined up directly with a spark plug cable lead terminal 34. Current flows through the rotor electrode 14 until the voltage becomes high enough to electrically break down the rotor gap 30. A spark is generated across the gap 30, causing a high tension current to flow in the spark plug cable to fire the associated spark plug. It is well known that the fast rise time impulsive high voltage current which flows at the onset of the electrical breakdown of rotor gap 30 creates radio frequency interference. It has also been found that the higher the breakdown voltage, the more radio frequency noise. Our invention provides a means of lowering the gap breakdown voltage to suppress radio noise interference by providing a rotor electrode 14 with a special tip 28. The electrode tip 28 comprises a material containing a conductive metal phase interspersed with refractory dielectric phase. The dielectric phase protrudes from the tip of the surface, encouraging ionization in the rotor gap 30 and gap breakdown at lowered voltages where RFI noise generation is suppressed. In cars equipped with our novel rotor electrodes radio noise caused by spark discharge across the rotor gap is so low that it is essentially inaudible.

Suitable electrically conductive materials for composite electrode tips according to our invention are those which are good electrical conductors and have melting points high enough that they are not substantially degraded by localized heating at the spark interface. Metals such as copper, nickel, silver, brass, aluminum and their high melting alloys are suitable, although other electrically conductive materials not mentioned may be as well suited.

Similarly, suitable dielectric materials have melting points high enough that they do not degrade because of localized heating at the spark interface. By dielectric materials we mean materials which do not readily conduct a flow of electrons. Silicon oxide and silica based glass particles have been successfully employed. Other suitable dielectric materials are the refractory oxides of metals such as copper, aluminum, titanium, gadolinium, and zirconium, for example. Obviously, other high melting dielectric materials would also be useful in the practice of our invention.

Generally, we have formed distributor gap electrode tips by compacting and sintering or hot pressing mixtures of suitable dielectric and metal particles. We have found that if the electrode composition comprises at least about 10% by volume of the dielectric material, breakdown voltages across the rotor gap are generally less than about 10 kV. We have successfully used both powder and chopped fibrous dielectric materials for the fabrication of our rotor electrodes. In some embodiments, we fused the dielectric and metal particles and then etched the surface to initially dissolve some of the metal and leave a rugged surface with a protruding dielectric phase. In other embodiments, the materials were pressed and sintered so that the particulate nature of each phase was maintained. The fabrication can also be manipulated so that one phase melts and the other does not. It does not appear to matter whether the metal or dielectric phases of a tip material are fused or particulate so long as the dielectric phase protrudes from the surface of the tip into the rotor gap. Preferably, the metal phase is continuous throughout the electrode tip material so that an electric current can flow unimpeded to the gap surface.

We have postulated several possible theories to account for the significant decrease in distributor gap breakdown voltages and resultant RFI noise suppression brought about by the use of our novel composite electrodes. However, these theories as set forth herein do not in any way limit the scope of our invention as claimed.

The voltage breakdown phenomena across a distributor gap are related to the electric field in the gap. The conduction of electricity (in the form of a spark) through the air in such a gap takes place by the transport of free electrons. Electrons are accelerated away from the electrode tip by an applied electric field and may collide with air molecules to produce more free electrons and air ions which in turn can collide with even more air molecules producing a so-called avalanche effect. The more electrons there are in the gap at a particular movement, the more probable it becomes that it will break down and spark. We believe that the rotor electrodes of our invention provide more initiatory electrons at the rotor gap at any given time at lower voltages than prior art rotors because of the dielectric particles protruding from the electrode at the gap.

There are several possible theoretical mechanisms by which these electrons may be generated. For example, electrons may be emitted from the protruding dielectric particles or phase in the high voltage electric field induced in the rotor electrode by the distributor secondary coil. Another possibility is that weakly bonded electrons which collect on the protruding dielectric particles are released into the gap at reduced breakdown voltage levels. Another possibility is that the field is enhanced around the protruding particles allowing electrons to be ejected at lower system voltages. It should be noted that all of these effects are related to the electrical phenomena associated with the protrusion of the dielectric particles at the electrically biased surface of a rotor electrode tip.

In the prior art, attempts have been made to suppress RFI noise by coating conventional metal rotor electrodes with a dielectric or semiconductive layer. Although this practice temporarily reduces RFI, probably because the coating layer functions as a resistor in series with the electrode, the therapeutic effect of the coating soon diminishes because it is eroded in service. Unlike such prior art electrodes, our invention provides a long lived and continuously operative noise suppressing rotor which is not adversely effected by use. In a rotor tip of our invention the rugged protruding surface of refractory dielectric material is constantly replenished. As the surface at the spark is slowly eroded, the dielectric material beneath is exposed. Tips have been periodically examined over the course of the equivalent of 50,000 miles of in-car service, and all such examinations revealed a surface with a protruding dielectric phase.

In accordance with a preferred embodiment of our invention, a RFI suppressing rotor electrode tip was formed as follows. 75 parts by weight, −200+300 mesh screened copper powder were thoroughly mixed with 25 parts by weight −140+325 mesh silica glass powder. These weight ratios correspond to about 57% by volume silica in the finished segment since copper is about four times as dense as silica. The silica glass has a dielectric constant of about 3.8 and its approximate composition is set out in Table I.

Table I

| Glass Phase Composition | |
|---|---|
| $SiO_2$ | 65% |
| $Al_2O_3$ | 7% |
| $B_2O_3$ | 18% |
| $Li_2O$ | 2% |
| $Na_2O$ | 2% |
| $K_2O$ | 3% |
| BaO | 3% |
| F | Minor |
| Other Impurity | <1% |

Figure 5:
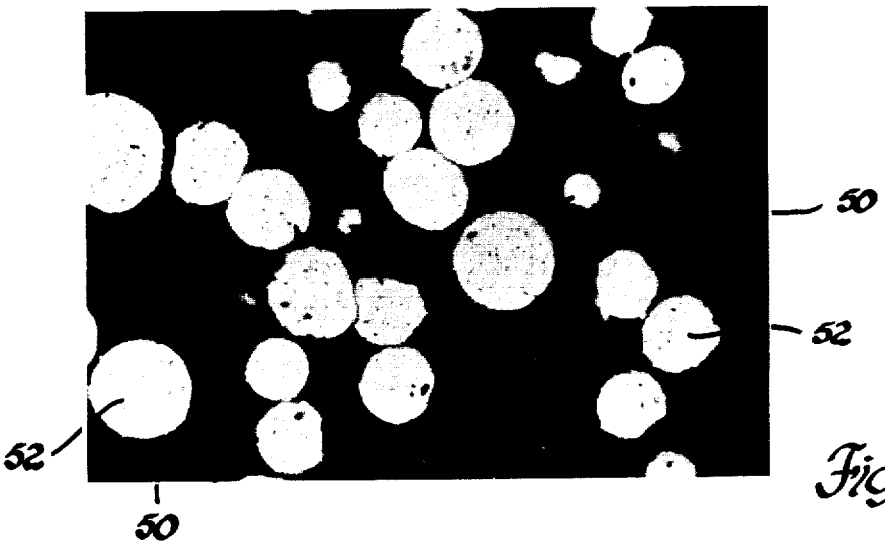
FIG. 5 is a photomicrograph of the surface of a rotor electrode tip of our invention at 250X magnification wherein the light areas are copper and the dark, silica glass.
Figure 6:
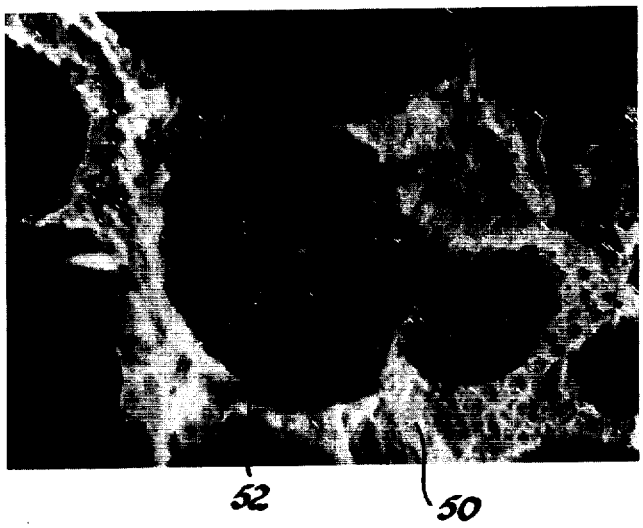
FIG. 6 is a scanning electron micrograph (SEM) at 1000X magnification of the surface of a rotor electrode tip of the invention showing a protruding silica glass phase within a copper matrix.

The powder mixture was introduced into the graphite dies of a hot vacuum press. The powder was compacted in a vacuum at 4000 psi at 1850° F. for 15 minutes and cooled under vacuum and load. Generally flat, rectangular distributor rotor electrode tips were cut from the hot pressed material with a diamond saw. FIG. 5 is a photomicrograph at 250X magnification showing the distribution of the glass phase 50 with the copper phase 52 at the surface of the hot pressed segment, the dark portions representing the glass 50, and the lighter circular portions, the copper 52. The copper phase is believed to be nearly continuous as the resistance across parallel faces of the segments was measured to be less than 10 ohms. The end of the rotor tip was etched with a 50% nitric acid solution to initially expose the glass particles. FIG. 6 is a scanning electron micrograph (SEM) of the etched surface showing a rugged lightly shaded glass phase 50 protruding from the darker shaded copper phase 52 as the result of the etching.

Figure 2:
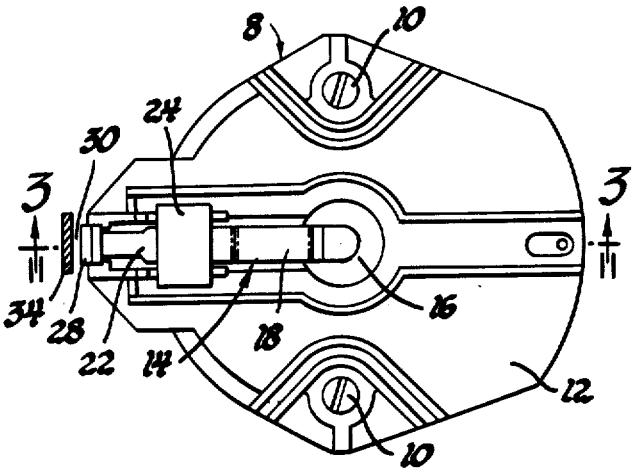
FIG. 2 is a plan view of the distributor rotor shown in FIG. 1.
Figure 3:
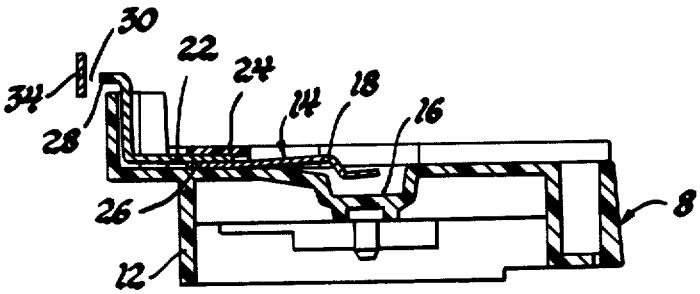
FIG. 3 is a sectional view of FIG. 2 taken along line 3—3 looking in the direction of the arrows.
Figure 4:
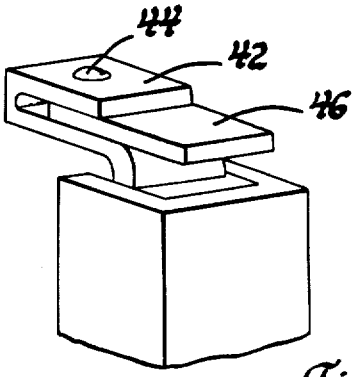
FIG. 4 is a perspective view of a part of a rotor used for testing electrode tips fabricated from various composite materials in accordance with the practice of our invention.

A rotor tip fabricated as above was tested in a rotor similar to that shown at FIGS. 2 and 3, equipped with a modified copper clamping electrode 42 shown at FIG. 4. Various tips 46 could be easily clamped in place for testing and removed for microscopic examination by manipulating screw 44. The test rotor was placed in an otherwise standard high energy automobile ignition distributor such as that shown in FIG. 1. The distributor was mounted in bench service testing equipment which simulates distributor operation in an automobile ignition system under controlled conditions. A spindle, corresponding to the rotor driving shaft in an automobile, was set to rotate the rotor at a desired rate and the primary distributor coil was connected to a 12V D.C. source. The distributor output terminals were shorted together and connected to ground through standard television and radio suppression (TVRS) spark plug cable. Testing was done with vacuum advance adjusted so that sparking occurred along the surface of the rotor electrode tip at the gap. The voltage at the rotor tip was monitored on an oscilloscope as a function of time. A Stoddart spiral cone antenna (No. 93490-1, 200–1,000 MHz) was placed in near field and interphased with a Hewlett Packard 8551-A Spectrum Analyzer to monitor the RFI noise at frequencies in the range of 0 to 1,000 MHz. The RFI noise output was measured on the spectrum analyzer in the range of from 0 to 40 decibels above one microvolt per meter per kilohertz (relative db). The tip was aged and tested in the bench equipment at a rotor speed of 1750 rpm for 500 hours, equivalent to about 50,000 miles of in-car service.

Figure 7:
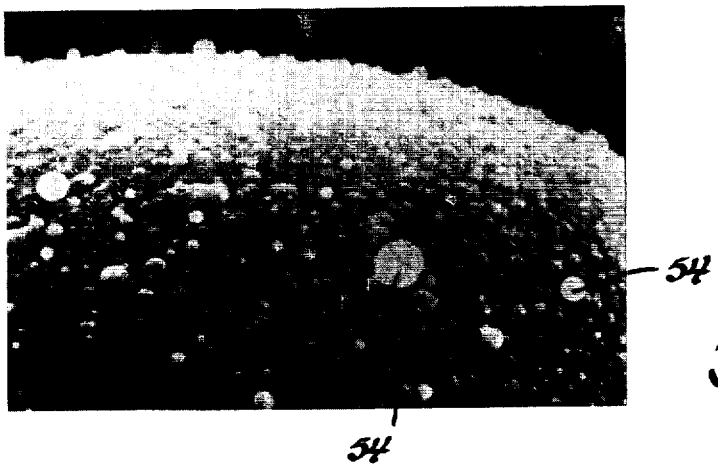
FIG. 7 is a SEM at 2000X magnification of charged dielectric silicon oxide particles protruding from a rotor electrode tip surface.

Throughout testing, the breakdown voltage was measured to be 8 kV or less compared to breakdown voltages of the same gap with a plain copper rotor tip of about 20 kV. The RFI output was judged quiet as measured by the spectrum analyzer, averaging less than 10 relative db over the entire frequency range. At several intervals during the 500 hours of testing the spark surface was observed under high magnification with a scanning electron microscope. FIG. 7 is a 3000X SEM showing a contour on the surface of the segment. The light colored nodules 54 represent points on the dielectric phase where the electric field is enhanced due to the SEM probe. These would also be the points where field enhancement could occur during distributor operation.

Figure 10:
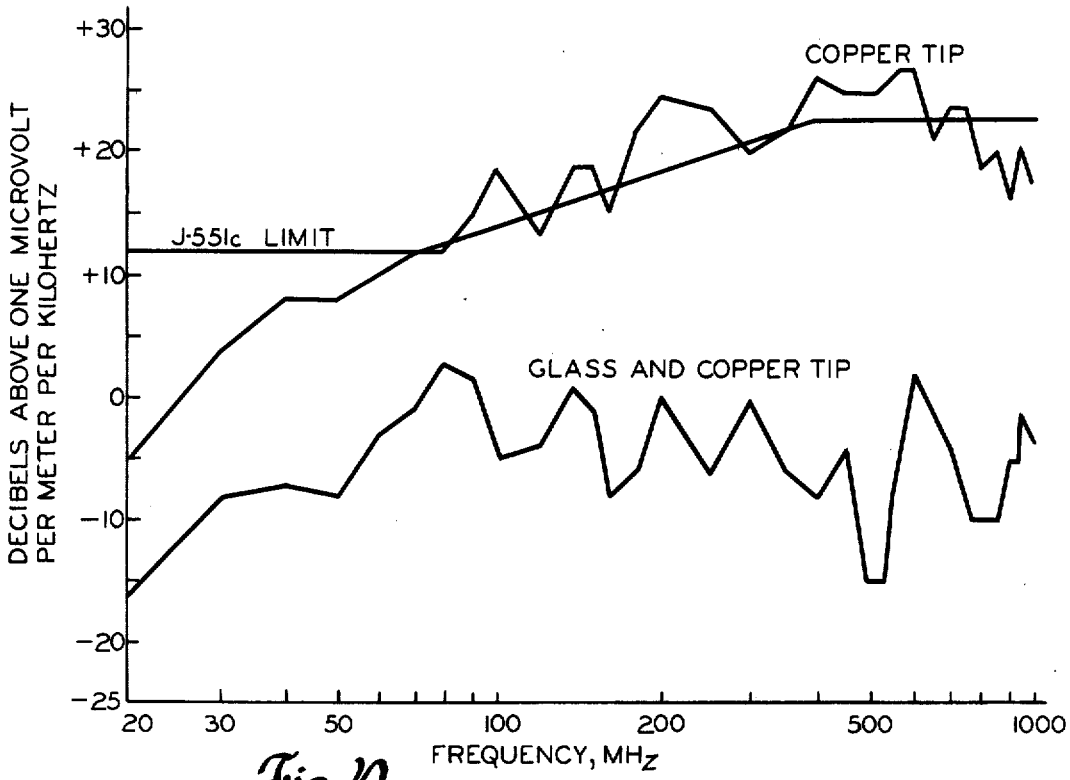
FIG. 10 is a graph of RFI noise intensity plotted as a function of frequency for a copper rotor electrode and a rotor electrode of the subject invention comprising a dielectric constituent of silica glass powder in a copper matrix.

Another rotor electrode tip, made as above, was tested in an eight cylinder 1977 Buick Riviera equipped with an otherwise standard high energy ignition distributor. After 500 hours of simulated road service, the distributor containing the rotor tip was tested for radio frequency interference noise using SAE test procedure J-551c. Briefly, the test procedure entails measuring the horizontal and vertical components of the RFI field (in units of relative decibels) received by an antenna positioned ten meters from the right and left hand sides of a vehicle. Noise readings are taken at suitable intervals over the frequency range of 20–1,000 MHz at bandwidths not greater than 1 MHz. The highest relative db signal measured at a particular frequency is recorded, and may be checked against the "quiet" radiation operating limit proscribed by the test. FIG. 10 shows the test results from the subject rotor tip. As can be seen from the Figure, the rotor electrode tip of our invention suppressed RFI signal generation to a level well below the acceptable noise limit according to the SAE J-551c test and well below the noise level reached with a plain copper rotor tip in the distributor of the same car.

Figure 8:
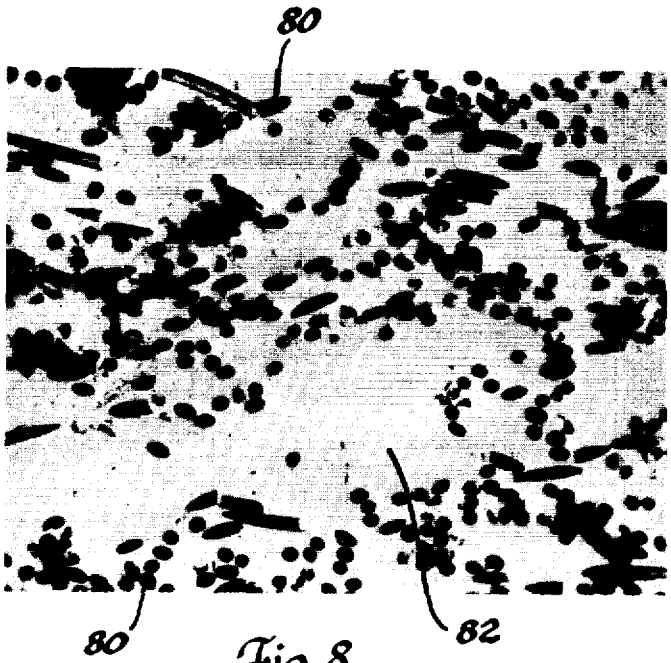
FIG. 8 is a photomicrograph at 250X magnification of silica fibers protruding from a copper matrix at the surface of a rotor electrode tip.
Figure 9:
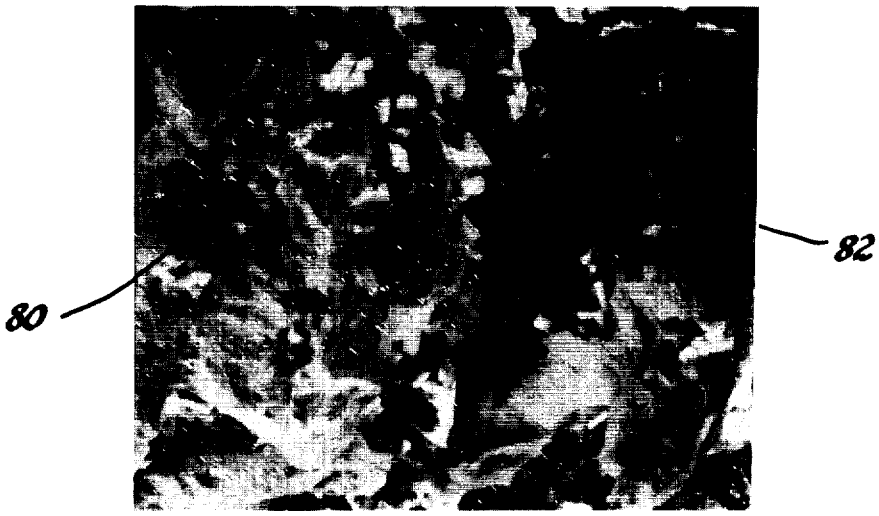
FIG. 9 is a SEM at 300X magnification of silica fibers protruding from a copper rotor electrode tip surface.

In another preferred embodiment, a RFI suppressing rotor electrode tip was formed from copper and fused silica fibers. Such fibers are particularly suited for the practice of the invention because one end can protrude from the metal phase while the other end is firmly embedded in it. Ten parts by weight chopped fused silica fibers, approximately 8 to 15 microns in diameter with a length to diameter ratio of at least 10, were mixed with 90 parts by weight −200+300 mesh copper powder and water in a high shear blender. The mixture was quickly transferred to a vacuum filter and dewatered. The dried material was vacuum hot pressed in graphite die at 1450° F. under a pressure of 4000 psi for 15 minutes. The compact was cooled under vacuum and load. A rotor tip was sawed from the hot pressed material and the end to be positioned at the spark gap was etched in a 50% nitric acid solution to expose the silica fibers. FIG. 8 is a photomicrograph at 250X magnification of a rotor tip formed by this method where the dark particles 80 are silica fibers and the lighter background matrix 82 is copper. FIG. 9 is a SEM at 300X magnification of the fibers 80 protruding from the copper matrix 82.

Figure 11:
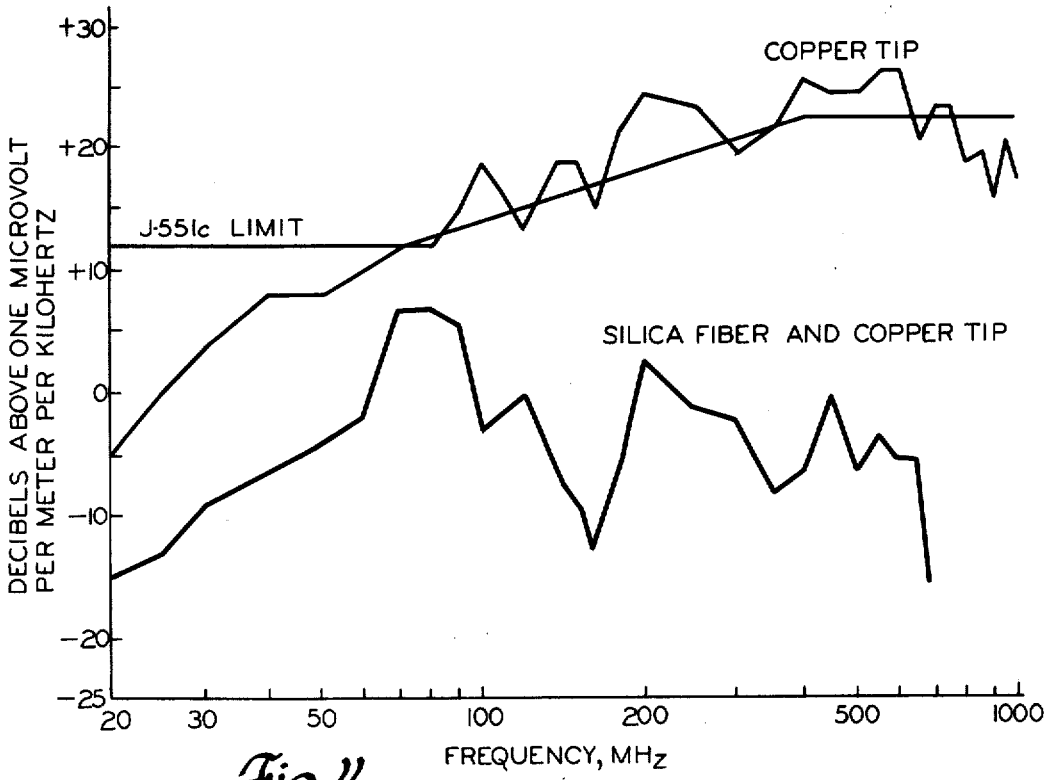
FIG. 11 is a graph as in FIG. 10 where the dielectric constituent of the rotor electrode tip of the subject invention is silica glass fibers.

The tip was clamped in a rotor like that shown at FIG. 4 and bench aged and tested in the equipment described above on a spindle rotated at 1750 rpm for 182 hours, approximately equivalent to 18,200 automobile miles. During the test period, the distributor gap breakdown voltage was measured to be 10 kV or less, and the RFI output was judged quite in the frequency range between 20 and 1000 MHz as measured by the spectrum analyzer attached to the conical antenna. The same rotor and tip were then transferred to the ignition distributor of a 1977 Buick. SAE J-551c was run for this rotor electrode tip and the results are shown at FIG. 11. It can be seen from the Figure that the distributor equipped with our rotor electrode tip easily meets the J-551c standards, and that RFI noise is substantially suppressed in relation to that generated with a plain copper tip.

Other electrode tip segments useful in the practice of our invention were made as follows. A mixture of 20% by weight copper oxide and 80% by weight silica refractory dielectric powder was combined with copper powder in amounts of 10, 5, and 2.5 percent by weight. The mixed powders were compacted at a pressure of about 17.5 tons per square inch. The compacts were then sintered in a hydrogen atmosphere for 30 minutes at 1500° F., repressed at a pressure of 25 tons per square inch, and resintered for another 30 minutes at 1500° F. in a hydrogen atmosphere. Distributor electrode tip segments were sawed from the material. In another embodiment, a powdered refractory dielectric mixture comprising by weight 30% gadolinium oxide, 60% silica and 10% copper oxide was combined with copper powder in amounts of 10, 5, and 2.5 percent by weight. The mixed powders were further processed as described directly above to form distributor electrode tip segments. All segments were found to reduce gap breakdown voltages to below 10 kV and reduce RFI noise to below 10 relative db in the bench testing equipment described herein.

Electrode tip segments were also formed with the following synthetic refractory dielectric fibers: Saffil®, comprising alumina and zirconium; Zircar®, comprising yttrium stabilized zirconium oxide; and Fiberfrax®, comprising alumina and silica. Chopped fibers less than about 100 microns in diameter with a length to diameter ratio of at least about 10 were mixed with 97.5, 95, and 90% by weight copper powder and agitated with water in a high shear blender. The mixtures were filtered, dewatered, and compacted under 17.5 tons per square inch pressure. The resulting compacts were sintered in a hydrogen atmosphere for 30 minutes at 1500° F., repressed at a pressure of 25 tons per square inch and resintered for 30 minutes at 1500° F. in a hydrogen atmosphere. Distributor electrode tip segments were sawed from the material. Tips tested in the bench testing equipment described herein were found to reduce gap breakdown voltages to below 10 kV and reduce RFI noise to below 10 relative db.

Other tip segments were formed from electroless copper or nickel plated fused silica fibers hot pressed with copper powder. 5 gram portions of fused silica fibers about 5 to 10 microns in diameter with length to diameter ratios of about 5 to 10 were prepared for electroless plating by immersion in 500 ml of a room temperature sensitizing solution. The solution contained 55 g/l reagent grade stannous chloride ($SnCl_2.2H_2O$) dissolved in distilled water. The fibers were rinsed in cold water and then immersed for three minutes in 500 ml of an activating solution heated to a temperature of 54° C. The activating solution contained 0.25 g/l palladium chloride ($PdCl_2$) and 4.5 ml/l reagent grade hydrochloric acid all dissolved in distilled water. The fibers were rinsed again in cold water and delivered to an electroless nickel or copper plating bath.

The copper bath comprised an aqueous solution 15 g/l copper sulfate ($CuSO_4.5H_2O$), 30 g/l reagent grade sodium tartrate $Na_2C_4H_4O_6.2H_2O$, 14 g/l sodium hydroxide (NaOH) and 10 ml/l of a 36% by weight solution of formaldehyde in water. 5 grams of the fibers pretreated as above were immersed in the bath at room temperature for about 15 minutes. The fibers were dried and weighed. The total weight of the electroless plated copper coating on the fibers was found to be 0.7 grams.

The nickel bath comprised an aqueous solution of 17 g/l nickel sulfate ($NiSO_4$), 13 g/l sodium hypophosphite ($NaH_2PO_2.H_2O$), 12 ml/l acetic acid. The solution was stabilized with 3 ml/l of a solution of 15.3 g of ammonium molybdate [$(NH_4)_6Mo_7O_{27}.4H_2O$] dissolved in a liter of water. The pH was adjusted to about 5.0 with sodium hydroxide. 5 grams of the fibers were immersed in the bath, maintained at a temperature of about 180° F., for about 15 minutes. The fibers were dried and weighed. The total weight of the electroless plated nickel coating on the fibers was found to be 1.4 grams.

The rotor electrode materials were made by mixing 2.5 parts by weight of the copper or nickel plated fibers with 97.5 parts by weight −200+300 mesh copper powder and water in a high shear blender. A mixture was then dewatered in a vacuum filter and vacuum hot pressed in a graphite die at 1450° F. at a pressure of 4000 psi for 15 minutes. Distributor electrode tip segments were sawed from the hot pressed composite materials. The tips tested in the bench testing equipment described herein reduced gap breakdown voltages to below 10 kV and RFI noise to below 10 relative db.

While our invention has been disclosed in terms of specific embodiments thereof, it will be appreciated that other forms could readily be adapted by one skilled in the art. Accordingly, the scope of our invention is to be considered limited only by the following claims.

What is claimed is:

1. In an ignition distributor system for an internal combustion engine of the type wherein a high voltage is produced for an engine spark plug by a high voltage electrical discharge across a gap between a distributor electrode and a spark plug lead terminal, the improvement wherein, at least an end portion of said electrode adjacent said gap consists essentially of interspersed phases of a dielectric material and an electrically conductive material, a portion of said dielectric material protruding from the end of said electrode into said gap, promoting breakdown across the gap and tending to suppress radio interference.

2. In an ignition distributor of the type wherein a rotating electrode has a tip which is rotated in a circumferential path to successive registrations with a plurality of circumferentially spaced stationary electrodes so as to define successive radial gaps across which arcs are established, the improvement wherein, the tip is composed of interspersed phases of a conductive material and a dielectric material, the dielectric material protruding from the conducting material to define a nonuniform electric field which encourages breakdown across the gap and tends to suppress radio interference.

3. In an ignition distributor of the type wherein a rotating electrode has a tip which is rotated in a circumferential path to successive registrations with a plurality of circumferentially spaced stationary electrodes so as to define successive radial gaps across which arcs are established, the improvement wherein, the tip contains interspersed phases of a dielectric material taken from the group consisting of silicon oxide and metal oxides, and an electrically conductive material, the dielectric material protruding from the conducting material to define a nonuniform electric field which encourages breakdown across the gap and tends to suppress radio interference.

4. In an ignition distributor of the type wherein a rotating electrode has a tip which is rotated in a circumferential path to successive registrations with a plurality of circumferentially spaced stationary electrodes so as to define successive radial gaps across which arcs are established, the improvement wherein, the tip contains interspersed phases of a dielectric material and a conductive material, said dielectric phase being present in an amount of at least 10% by volume of the tip, the dielectric material protruding from the conducting material to define a nonuniform electric field which encourages breakdown across the gap and tends to suppress radio interference.

5. In an ignition distributor of the type wherein a rotating electrode has a tip which is rotated in a circumferential path to successive registrations with a plurality of circumferentially spaced stationary electrodes so as to define successive radial gaps across which arcs are established, the improvement wherein, the tip contains a silica glass phase interspersed with a copper phase, said silica glass being present in an amount of at least 10% by volume of the tip, said glass phase protruding from the copper to define a nonuniform electric field which encourages breakdown across the gap and tends to suppress radio interference.

* * * * *